US006422618B1

(12) United States Patent
Guldner et al.

(10) Patent No.: US 6,422,618 B1
(45) Date of Patent: Jul. 23, 2002

(54) PERSONAL SECURITY LOCK FOR USE WITH A CAMPER SHELL OF A TRUCK

(76) Inventors: David Guldner, 1250 Prescott Ave., Sunnyvale, CA (US) 94089; Efrain Quiles, 573 Valley Forge Way, Unit #2, San Jose, CA (US) 95117

( * ) Notice: Subject to any disclaimer, the term of this patent is extended or adjusted under 35 U.S.C. 154(b) by 0 days.

(21) Appl. No.: 09/565,332

(22) Filed: May 5, 2000

(51) Int. Cl.[7] ..... E05C 19/18

(52) U.S. Cl. ..... 292/241; 292/1; 292/DIG. 29; 292/DIG. 43; 292/258; 292/241; 292/288

(58) Field of Search ..... 292/288, 258, 292/1, DIG. 29, 49, 53, DIG. 43, 359, 241

(56) References Cited

U.S. PATENT DOCUMENTS 3,683,652 A * 8/1972 Halopoff et al. ..... 70/146
4,695,083 A * 9/1987 Hermeyer ..... 292/241
4,728,131 A * 3/1988 Burns ..... 292/7
4,898,408 A * 2/1990 Hauber ..... 292/7
5,072,978 A * 12/1991 Woodward ..... 292/359
5,150,934 A * 9/1992 Grody ..... 292/288
5,174,456 A * 12/1992 Grody ..... 292/288
5,738,397 A * 4/1998 Grody et al. ..... 292/258

* cited by examiner

*Primary Examiner*—Robert J. Oberleitner
*Assistant Examiner*—Benjamin A. Pezzlo
(74) *Attorney, Agent, or Firm*—Oppenheimer Wolff & Donnelly, LLP

(57) ABSTRACT

An apparatus is provided for locking and unlocking a camper shell from the inside. The device can be purchased as an inexpensive after market part and easily and quickly installed without the need for expensive tooling. The device includes a handle having proximal and distal ends and fashioned with a lateral bore at its proximal end for connecting with a torsion bar already existing on the latching mechanism of the camper shell. The distal end of the handle includes a cam, pivotally connected thereto, which can move between a position which in which the cam is generally flush with the handle and other positions in which the cam extends laterally from the handle. A cam lock is provided to engage the cam and hold it in one or more selected positions, the positions providing corresponding amounts of lateral extension from the handle. The when extended, the cam prevents the handle from being turned, thereby preventing the camper shell from being opened.

18 Claims, 8 Drawing Sheets

PERSONAL SECURITY LOCK FOR USE WITH A CAMPER SHELL OF A TRUCK

FIELD OF THE INVENTION

The present invention relates to personal security devices and more particularly to a device for locking a camper shell of a truck from within the camper shell.

BACKGROUND OF THE INVENTION

For many years pickup trucks have maintained a high degree of popularity due in large part to their versatility and utility for transporting a wide variety of personal items. In order to increase this inherent utility of pickup trucks, many owners have chosen to add camper shells to their trucks. Adding a camper shell to a truck greatly increases the utility of the truck by keeping stored items safe from the elements and safe from theft. Such a camper shell is also commonly used as a temporary shelter wherein an occupant can sleep or rest such as at a camping site or a highway rest stop.

FIG. 1, illustrates such a pickup truck, generally referred to as 10. The truck 10 includes a portion, generally referred to as a bed 12. Upon the bed 12 is a camper shell 14. With reference to FIG. 2, the aft portion of the truck 10 includes a tailgate 16 and the shell 14 includes a shell-gate 18 which may optionally have a window 19 therein. The shell-gate 18 is hingedly connected at its top 20 to the rest of the shell 14 by means of a piano hinge or some similar device. The shell gate also includes a pair of exterior handles 22 which can be used to latch the shell gate in a closed position or to unlatch it to open it.

With reference now to FIG. 3 a view of the inside of such a standard camper shell reveals a latch bar 24 which is operable in response to turning the handles 22 (FIG. 2) at the exterior of the shell 14. The latch bar 24 pivots in an arcuate fashion from a generally horizontal position to a generally vertical one. When the latch bar 24 is in the horizontal position it holds the shell gate in a closed position by abutting the door frame 26, defined by the back, outer edge of the shell 14. When the latch bar is moved to the vertical position it clears the edge of the camper shell, allowing the shell gate 18 to be swung open. A stiffener 28 in the form of a metallic extrusion extends along the inner edge of the door frame 26 to provide added stiffness to the shell 14. This stiffener 28 stops short of the bottom of the door frame.

With reference now to FIG. 4(*a*) the exterior handles 22 are connected with the latch bar 24 by means of a torsion bar 30 which extends through the shell gate 18 and is fixedly connected with both the exterior handle 22 and the latch bar 24. A key lock (not shown) is also generally provided and is operable only from outside the shell 14 by use of a keyhole located at the exterior end of the torsion bar 30. While this lock is not shown, such locks will be familiar to those skilled in the art. This lock is useful in protecting items stored therein from theft when the truck 10 is to be unattended. However, as mentioned, the lock is only operable from outside of the vehicle. If an occupant intends to sleep inside the camper shell, the camper shell cannot be locked from the inside. What's more, even latching the shell gate 18 without locking it is difficult because the latch bar 24, not being designed as a handle, is generally flat and difficult to grasp. If an occupant wishes to lock the camper shell 14 to sleep therein, he or she must lock the shell gate 18 from the outside and then crawl through a small opening (not shown) between the cab of the truck and the front, interior of the shell. This is difficult at best and may even be impossible since not all trucks are equipped with such windows and the person may be too large to fit through the window. If the person succeeds in locking the camper shell 14 and the crawling through the small front window, he or she will be at risk, since quick egress in the case of a fire or some other emergency will not be possible. Therefore there remains a need for a device which will enable an operator to quickly and easily lock and unlock a camper shell from the inside. Such a device would preferably be available as an after market device which can be easily and inexpensively installed without the need for expensive tooling.

SUMMARY OF THE INVENTION

The present invention provides an apparatus for locking and unlocking a camper shell from the inside. The device can be purchased as an inexpensive after market part and easily and quickly installed without the need for expensive tooling. The device includes a handle having proximal ends and fashioned with a lateral bore at its proximal end for connecting with a torsion bar already existing on the latching mechanism of the camper shell. The distal end of the handle includes a cam, pivotally connected thereto, which can move between a position in which the cam is generally flush with the handle and a position in which the cam extends laterally from the handle. A cam lock is provided to engage the cam and hold it in one or more selected positions, the positions providing corresponding amounts of lateral extension from the handle.

In an aspect of the invention, the cam can be locked in one or more pre-selected positions. This can be accomplished, for example, by providing recesses in the cam, which align with a cam-lock pin which slides with a bore in the handle and is operable by a knob. When the cam is in a desired position, the pin can be moved into the recess in the cam, thereby locking the cam in position. Pulling on the knob releases the cam so it can be turned. When the knob is pulled and rotated approximately half a turn it remains disengaged from the cam so that the cam can be turned without having to keep the knob pulled out. Such locking can also be provided by a spring loaded ball bearing within a closed bore in the handle, the spring forces the bearing into a recess or detent in the cam causing it to lock in that position. The lock can be overcome by forcing the cam in to another position, overcoming the bias of the spring against the bearing and forcing the bearing out of the recess or detent in the cam.

In another aspect of the invention, the handle can be affixed to the torsion bar of the camper shell by providing set screws extending through threaded bores into the bore that receives the torsion bar. The set screws can contact and engage the torsion bar, so that the handle can apply a torque to the torsion bar. In another aspect of the invention, when the torsion bar has a non-circular cross section, for example square or keyed, the bore in the handle can be configured with a corresponding cross sectional shape. In this manner, when the handle is turned the interior surface of the bore can engage the exterior surface of the torsion bar to apply a torque thereto.

In an alternate embodiment of the invention, a lock pin can be provided in place of the cam earlier described. In this embodiment the handle can be provide with a lateral bore, parallel with the bore that receives the torsion bar of the camper shell. A lock pin operable by a knob extends through this bore, the amount of extension being controlled by the knob. When extended, the lock pin engages a structural member of the pickup shell and prevents the handle from being raised.

In yet another embodiment of the invention, the handle can be pivotally connected at its distal end with an elbow which can be manually bent to extend laterally from the handle and engage the structural member of the shell to prevent lifting the handle. This elbow can be biased in certain pre-selected positions as described above. These and other advantages of the present invention will become apparent to those skilled in the art upon a reading of the following descriptions of the invention and a study of the several figures of the drawings.

BRIEF DESCRIPTION OF THE FIGURES

The invention will be better understood when consideration is given to the following detailed description thereof. Such description makes reference to the annexed drawings wherein.

DETAILED DESCRIPTION OF EMBODIMENTS OF THE INVENTION

Figure 3A:
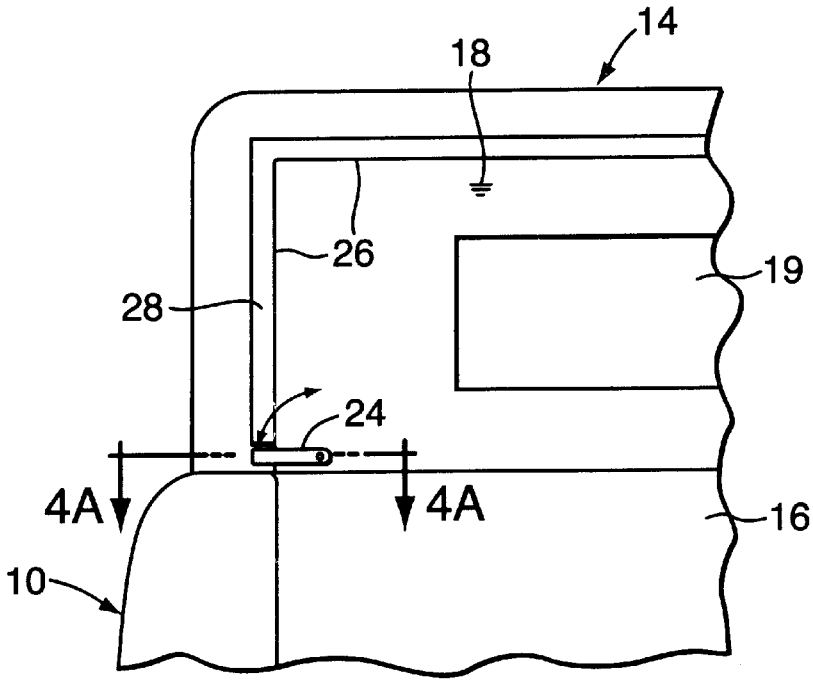
FIG. 3A (PRIOR ART)
FIG. 3A is a view of the background art, taken from line 3—3 of FIG. 1, shown enlarged.
Figure 3B:
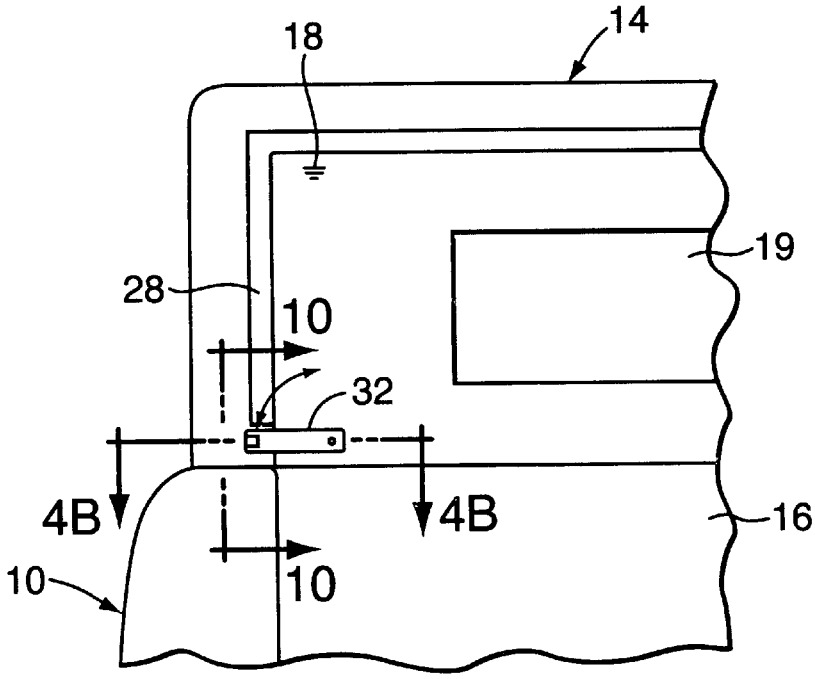
FIG. 3B is a view illustrating the present invention, taken from line 3—3 of FIG. 1, shown enlarged.
Figure 4A:
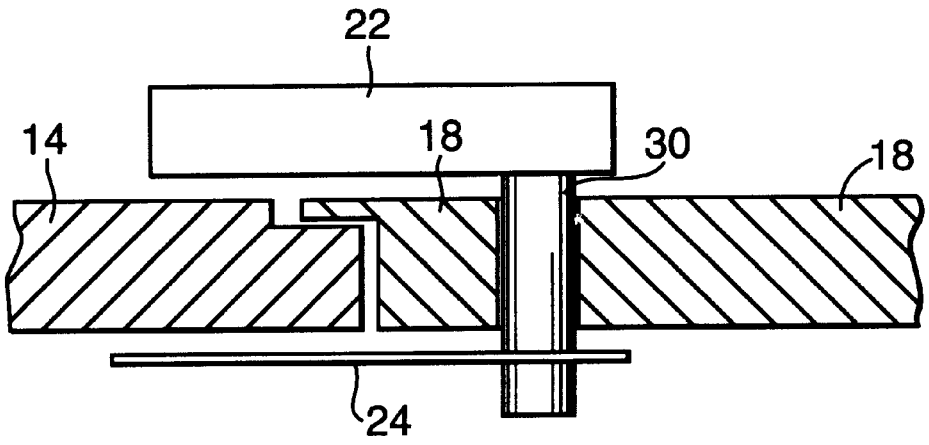
FIG. 4A (PRIOR ART)
FIG. 4A is a view of the background art, taken from line 4A—4A of FIG. 3A, shown enlarged.
Figure 4B:
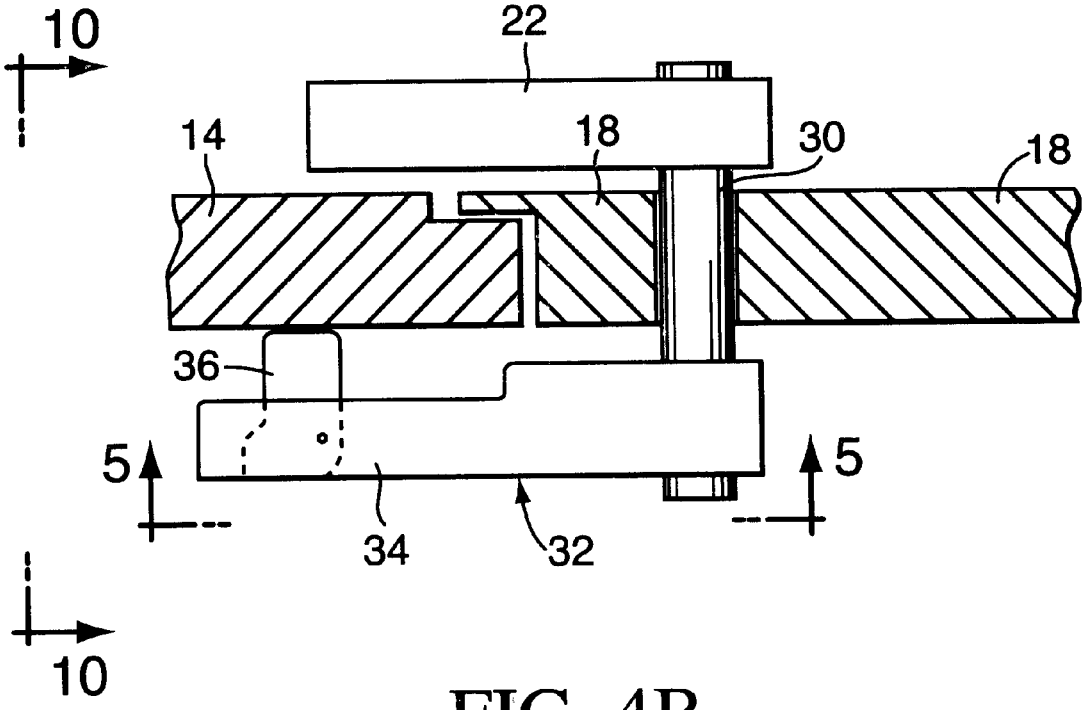
FIG. 4B is a view of the present invention, taken from line 4B—4B of FIG. 3B, shown enlarged.

With reference to FIGS. 3B and 4B, the present invention is embodied in a security lock generally referred to as 32. The security lock 32 includes a handle 34 (FIG. 4B), which attaches at its proximal end to the torsion bar 30 of the pickup shell 14. The distal end of the handle 34 has attached thereto a cam 36 which, based upon its angular position, can be either flush with the handle 34 or extended from the handle 34 some selected amount.

Figure 5:
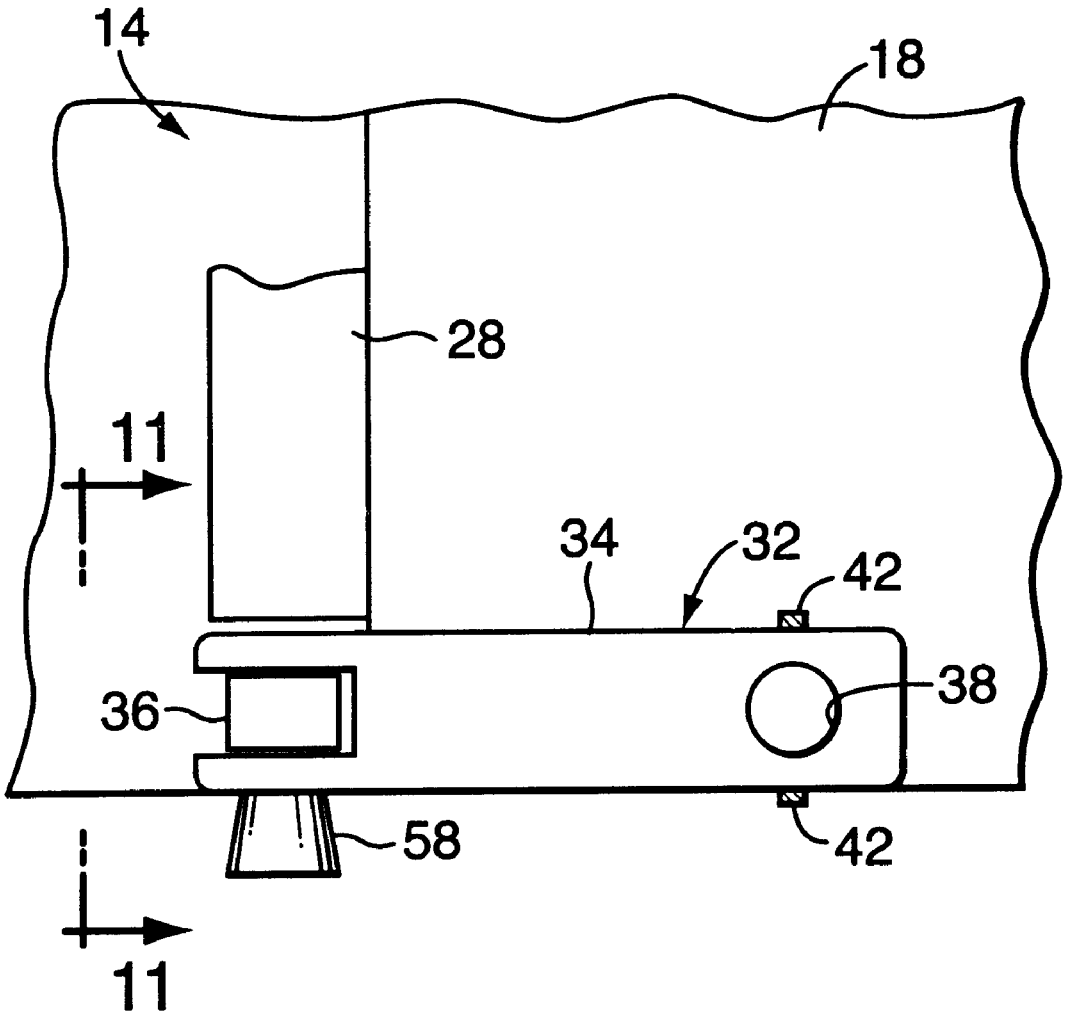
FIG. 5 is a view taken from line 5—5 of FIG. 4B.

With reference now to FIG. 5, the proximal end of the handle 34 includes a cylindrical bore 38 configured to receive the torsion bar 30 of the camper shell 14. A pair of smaller threaded bores 40 (FIG. 6, 7) extend into the bore 38, each receiving a set screw 42. When installed, the set screws engage the torsion bar 30, holding the handle 34 securely thereto. In the preferred embodiment the bore 38 is cylindrical and engages the torsion bar 30 by means of the set screws 42 in order to accommodate a wide variety of torsion bars 30. However, as will be appreciated by those skilled in the art, other configurations of bores are possible. For example, the bore can have a square cross section to engage a torsion bar having a square cross section. Alternatively, the bore could have a semicircular cross sections with a flat, key portion to engage a similarly constructed torsion bar.

Figure 6:
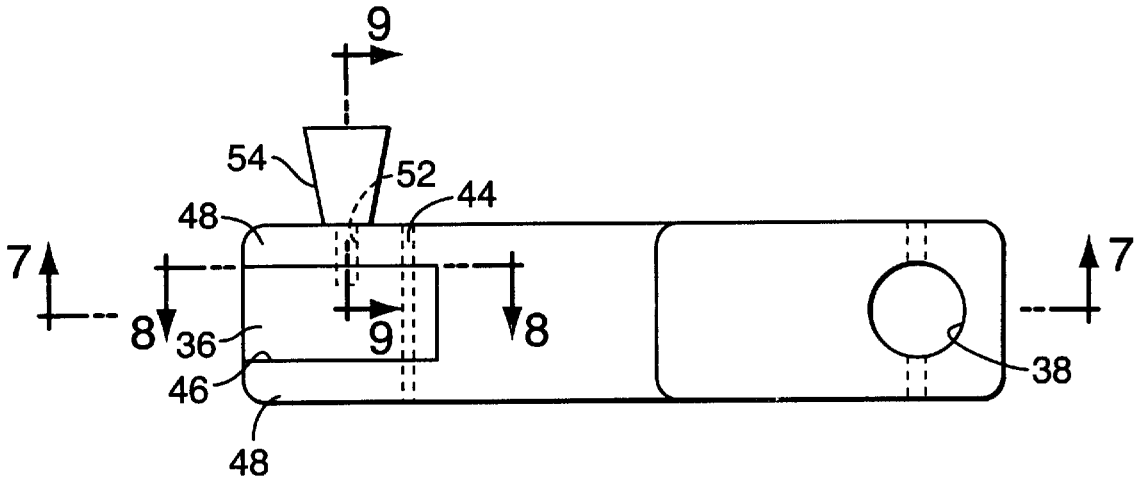
FIG. 6 is a view of an embodiment of the present invention.
Figure 7:
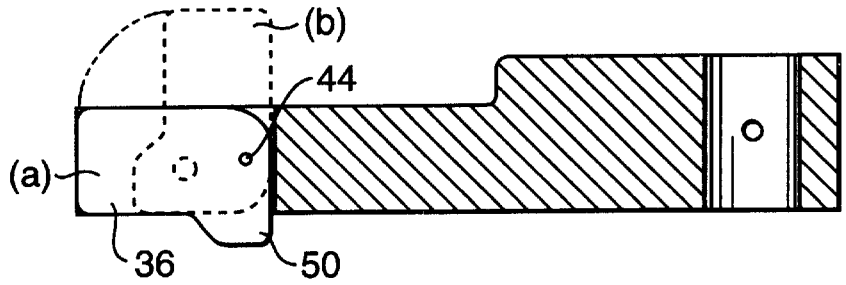
FIG. 7 is a cross-sectional view taken from line 7—7 of FIG. 6.

With reference now to FIGS. 6 and 7, the cam 36 is pivotally connected to the handle by a pivot pin 44, which defines a pivot point. As can be seen with reference to FIG. 6, the cam 36 is held within a clevis 46 between a pair of tines 48 and moves about the pivot point from an essentially flush position (a) to a fully extended position (b). The cam 36 includes a lobe 50 which, when the cam 36 is in the flush position (a) extends from an edge of the clevis 46. The lobe 50 can be used to manually urge the cam 36 out of the flush position (a).

Figure 8:
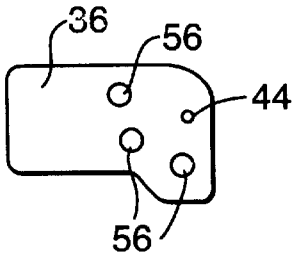
FIG. 8 is a cross-sectional view taken from line 8—8 of FIG. 6.

With continued reference to FIGS. 6 and 7, one of the tines has a cylindrical passage 52 extending from the outer surface of the tine to the inner surface of the tine. A cam-lock pin 54 slides with the passage 52 to enter the interior of the clevis 46 to engage the cam 36. With reference to FIG. 8, the cam 36 includes a plurality of detents 56 into which the tip of the cam-lock pin 54 fits to engage the cam 26. The detents 56 are positioned such that when the cam-lock pin 54 enters one of the detents, it holds the cam in one of a plurality of pre-selected positions. Preferably, the cam 36 includes three such detents to hold the cam in three pre-selected positions, which preferably include: the flush position (a); the fully extended position (b); and an intermediate position which is preferably 45 degrees.

Figure 9:
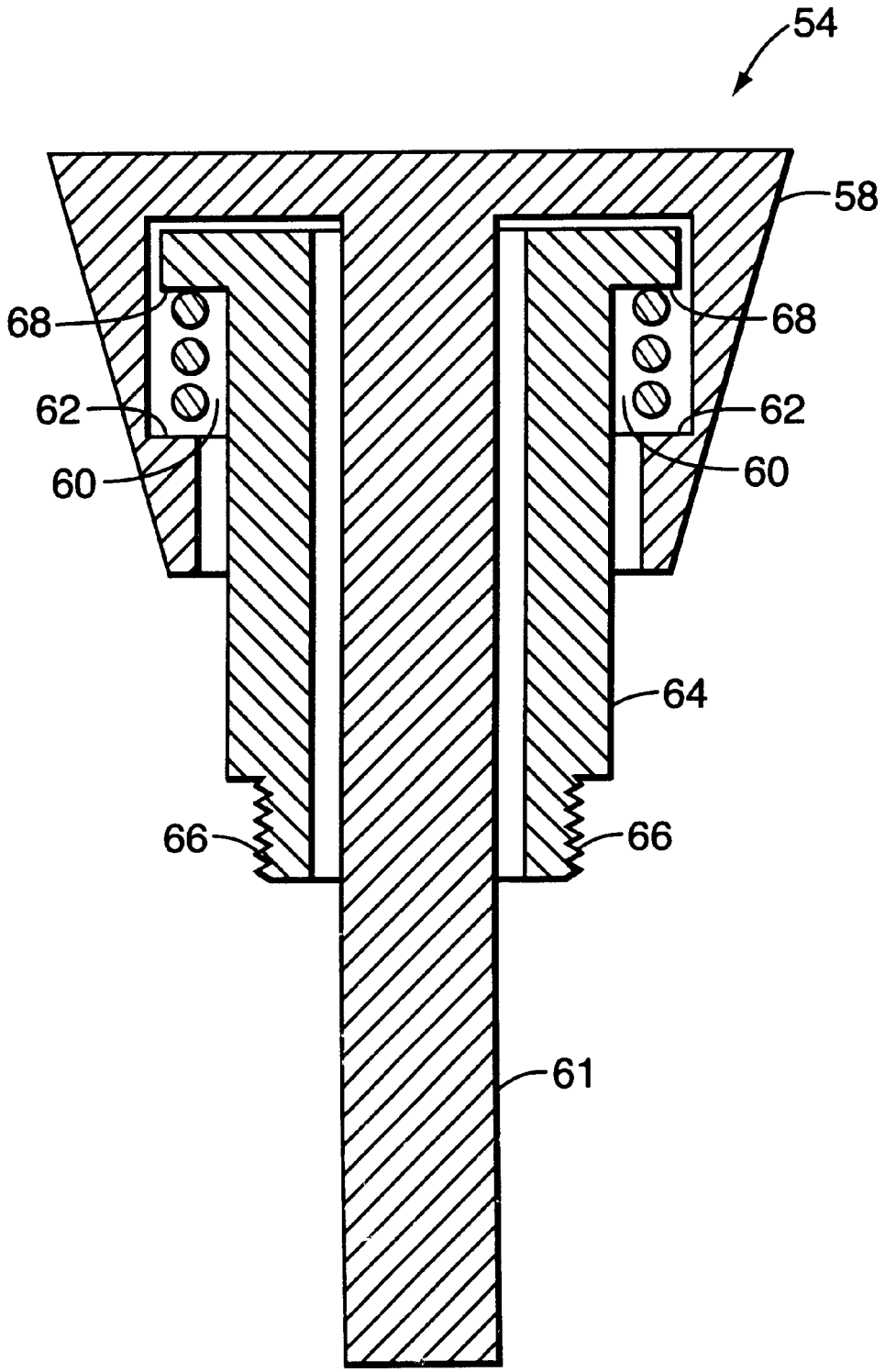
FIG. 9 is a cross-sectional view taken from line 9—9 of FIG. 6, shown enlarged.

With reference now to FIG. 9, the cam-lock pin 54 includes, at its exterior end, a knob 58, which extends downward to define a hollow cavity 60 between a shaft 61 of the pin 54 and the interior of the handle. The bottom, interior extremity of the hollow knob 58 is formed with an inward, annular lip 62. A collar 64 slides upon the shaft 61 of the pin 54 and fits partially within the cavity 60 of the knob 58. The collar includes recessed, external, annular threads 66, which engage a complimentary set of internal threads (not shown) formed in the external end of the cylindrical passage 52 in the tine 48 through which the pin 54 slides when installed. The collar 64 also includes, at its end opposite its threaded end, an outward extending annular lip 68. Disposed between the annular lip 68 of the collar 64 and the annular lip 62 of the knob 58 is a spring 70. The spring biases the pin 54 such that the shaft 61 is in its extended position (i.e. toward the cam 36 (FIG. 6) when installed).

With reference to FIGS. 4A and 4B, to install the security lock, the user must first remove the latch bar 24 that comes with the camper shell. The security lock 32 is then installed by inserting the torsion bar 30 of the camper shell into the bore 38 of the handle 34. The handle 34 is then positioned so that it is parallel with the exterior handle 22 of the shell 14, and the set screws 42 are tightened. The security lock is then ready for use. While the invention has been described with reference to one side of the shell gate 18, it should be noted that the invention can be used on either or both sides of the gate 18. An embodiment designed for one side of the gate is essentially configures as a mirror image of the embodiment designed for the other.

Figure 10:
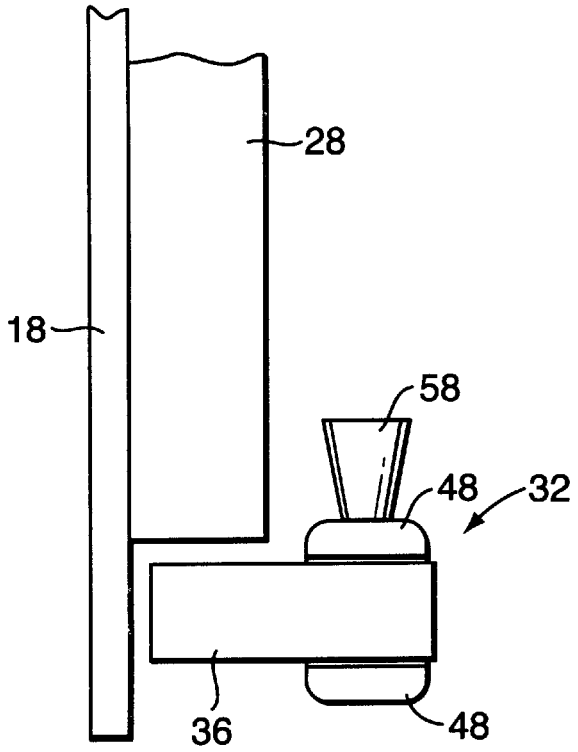
FIG. 10 is a view taken from line 10—10 of FIG. 4B, shown enlarged.
Figure 11:
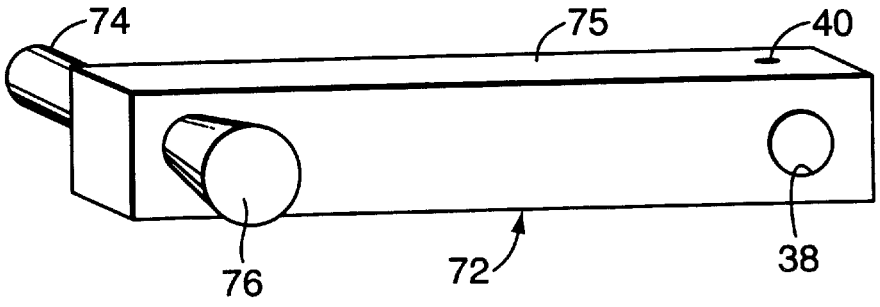
FIG. 11 is a perspective view of an alternate embodiment of the invention.

With reference to FIG. 4B, to use the security lock, the user must first enter the shell 14. Then the cam 36 must be positioned in the flush position (FIG. 7) by pulling on the knob 58 of the cam-lock pin 54 and manually turning the cam 36 to the flush position. With the tailgate 16 of the truck 10 closed, and the handle 34 of the security lock 32 in a generally vertical position, the shell gate 18 is closed and then the handle 34 is turned to a horizontal position. With reference to FIG. 10, it can be seen that moving the handle 34 to the horizontal position moves it past the bottom end of the stiffener 28. With reference now to FIG. 11, the cam is moved to an extended position by lifting the knob 58 of the cam-lock pin 54 and turning the cam 36 to the desired extended position. The knob 58 is then released, locking the cam 36 in the desired position. It will be appreciated that placing the cam in the extended position disposes it directly below the stiffener 28 of the shell 14. Any attempt to open the camper shell gate 18 will require raising or moving the handle to an upright position. However, the cam will abut the bottom of the stiffener 28 thereby preventing the handle from being moved upward. The camper shell is now effectively locked from the inside. In order to exit the vehicle, the occupant simply lifts the knob 58 and moves the cam to the flush position. The handle can now be raised and the camper shell opened. It should be noted that use of the present invention does not provide an absolute guarantee of security from a sufficiently motivated perpetrator since no device can provide absolute protection. However, properly used, the present invention provides an effective deterrent to potential intruders.

With reference now to FIG. 11, in an alternate embodiment of the invention 72, a pin 74 is used in place of the cam 36 to lock the handle 75. To use this embodiment, the user pulls a knob 76 to retract the pin 74. The handle 75 is then moved to a horizontal position and the pin 74 is extended using the knob 76. The extended pin 74 will engage the stiffener 28 of the camper shell much like the cam 36 of the earlier described embodiment, thereby locking the camper shell. It will be appreciated that the knob 76 and pin 74 can be constructed similar to the cam-lock pin 54 and knob 58 described with reference to FIG. 9. Furthermore, a mechanism, (not shown) can be provided for locking the pin 74 in the retracted position.

Figure 1:
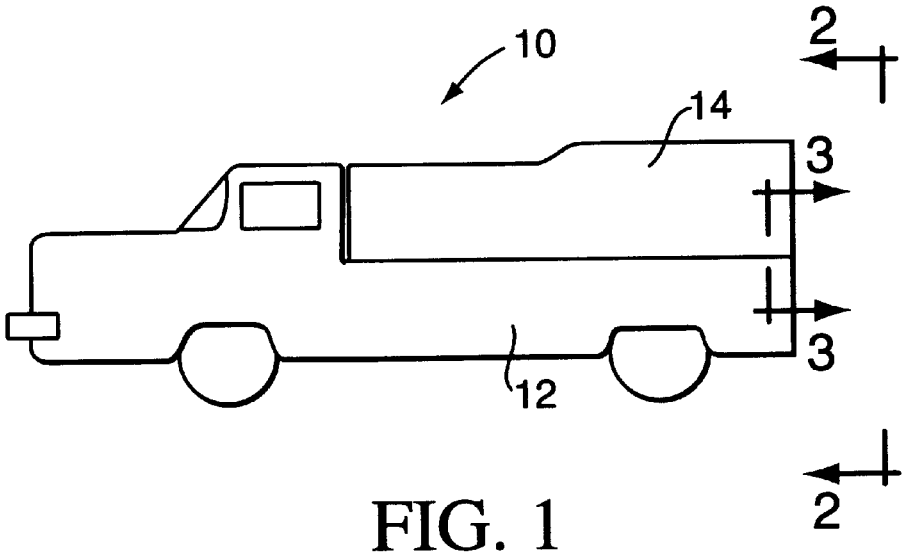
FIG. 1 (PRIOR ART)
FIG. 1 is a view of the background art showing a profile of a pickup truck having a camper shell attached thereto.
Figure 2:
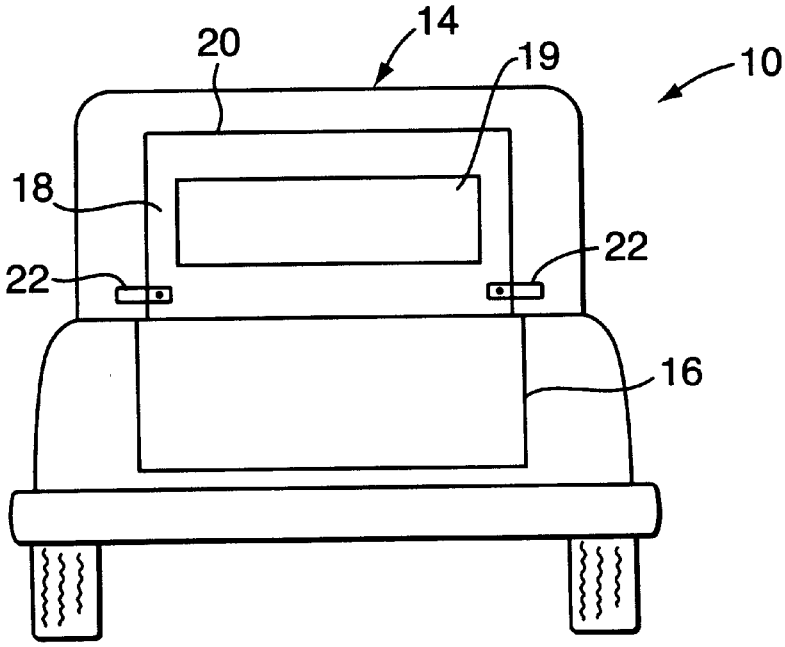
FIG. 2 (PRIOR ART)
FIG. 2 is an aft view of the pickup truck as taken from line 2—2 of FIG. 1, shown enlarged.
Figure 12:
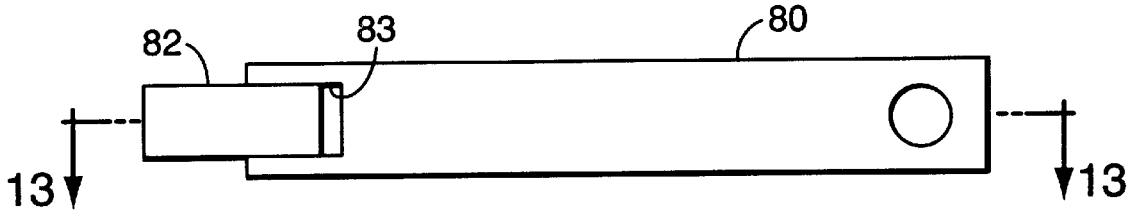
FIG. 12 is a profile view of another embodiment of the invention.
Figure 13:
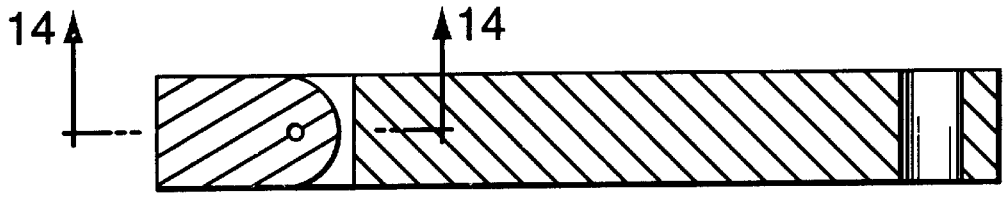
FIG. 13 is a cross sectional view taken from line 13—13 of FIG. 12.
Figure 14:
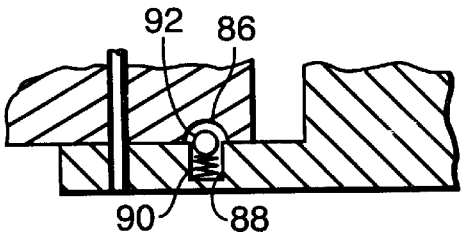
FIG. 14 is a cross sectional view taken from line 14—14 of FIG. 13.

With reference to FIGS. 12—14, another embodiment 78 of the invention includes a handle 80 having an elbow 82 pivotally connected thereto. The handle includes a bore 38 for receiving the torsion bar 30 (FIG. 4*a*) similar to the earlier described embodiments. A clevis, 83 at an end of the handle 80 contains the elbow 82 and a pivot pin 84 mounts the elbow 82 pivotally within the clevis 83. With reference to FIG. 15, the elbow is biased in selected positions. One or more recesses 86 are provided in a surface of the elbow at predetermined locations. One or more corresponding cylindrical bores 88 are provided in an interior surface of the clevis. A spring 90 supports a ball bearing 92 within the bore 88, and biases the bearing against the elbow 82 and into the recess 86. To use this embodiment of the invention, the handle 80 is moved to a horizontal position with the shell 14 of the truck 10 (FIG. 1) and the elbow 82 is manually turned to a bent configuration causing it to abut the stiffener 28 if an attempt is made to open the shell 14.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A security lock for locking a vehicle enclosure from within the enclosure the vehicle enclosure having a gate with a latching mechanism including a torsion rod, the security lock comprising:

a. a handle body having a proximal end and a distal end, and formed at said proximal end with a sleeve configured for receiving and engaging the torsion rod of the latching mechanism of the gate of the camper shell;

b. a cam pivotally connected with said distal end of said body and configured to extend laterally from said body a predetermined amount depending upon a selected pivotal position of said cam relative to said body; and c. a cam lock, moveably connected with said body for engagement with said cam for holding said cam in said selected position.

2. A security lock for locking a camper shell gate as recited in claim 1, wherein:

a. said cam has at least one recess disposed in a side thereof;

b. said body has a cylindrical passage disposed near said distal end of said body and having a longitudinal axis parallel with the pivotal axis of said pivotal connection of said cam with said body; and c. said cam lock is a pin moveably disposed within said passage for selective engagement with said recess of said cam to thereby hold said cam in said selected position.

3. A security lock for locking a camper shell gate as recited in claim 2, wherein said pin is biased toward said cam.

4. A security lock for locking a camper shell gate as recited in claim 1, further comprising:

a. a threaded bore perpendicular with and extending into said sleeve; and b. a set screw disposed within said threaded bore, in threaded engagement therewith for extension within said sleeve for selective engagement with said torsion rod of said camper shell.

5. A security lock for locking a camper shell gate as recited in claim 1 wherein said sleeve is configured for mechanical engagement with a surface of said torsion rod of said camper shell to preclude rotational movement of said torsion rod within said sleeve.

6. A security lock a as recited in claim 1 wherein said cam includes a plurality of detents and said cam lock includes a pin engageable with said detents to lock said cam in a plurality of said selected pivotal positions.

7. A security lock for locking a vehicle enclosure from within the vehicle enclosure, the vehicle enclosure having a gate with a latching mechanism including a torsion rod, the security lock comprising:

a. a handle having a proximal end and a distal end;

b. an opening, formed laterally in said proximal end of said handle and configured to receive and engage said torsion rod of said shell gate latching mechanism therein;

c. a bore extending laterally through at least one side of said handle near said distal end of said handle;

d. a lock-pin slidably held within said bore for selective extension from said bore.

8. A security lock as recited in claim 7 wherein said bore extend through said handle and wherein said lock pin includes a pin-grasp at one end, extending through a first side of said handle, and wherein said lock pin extends from said bore opposite said pin grasp.

9. A security lock as recited in claim 7 wherein said pin is biased in an extended position.

10. A security lock as recited in claim 7 wherein said pin travels between a position which is essentially flush with said handle a fully extended position, and wherein said handle is lockable at one or more positions within that range of travel.

11. A security lock as recited in claim 7 wherein said bore includes internal threads and wherein said lock-pin includes complimentary external threads, whereby rotation of said lock-pin within said bore controls said extension of said set-pin from said bore.

12. A security lock as recited in claim 7 wherein said opening for receiving said torsion rod of said camper shell latching mechanism is configured with a cross section complimentary to said torsion rod allowing said handle to engage said torsion rod and apply torque thereto.

13. A security lock as recited in claim 7 further including a set pin extending into said opening to engage said torsion rod.

14. A security lock for locking a vehicle enclosure from within the enclosure, the enclosure having a gate with a latching mechanism including a torsion rod, said security lock comprising:

a. a handle having a proximal end and a distal end;

b. a aperture formed laterally in said handle for engagably receiving said torsion rod therein; and c. a lock-tab moveably connected with said distal end of said handle between a position which is essentially flush with a side of said handle and a position extending from said side of said handle.

15. A security lock as recited in claim 14 wherein said tab is pivotally connected with said handle.

16. A security lock as recited in claim 14 further including a means for locking said tab in either of said flush position and said extended position.

17. A security lock as recited in claim 14 wherein said opening for receiving said torsion rod of said camper shell latching mechanism is configured with a cross section complimentary to said torsion rod allowing said handle to engage said torsion rod and apply torque thereto.

18. A security lock as recited in claim 14 further including a set pin extending into said opening to engage said torsion rod.

* * * * *